United States Patent [19]

Salaverria

[11] Patent Number: 4,896,440

[45] Date of Patent: Jan. 30, 1990

[54] COMPOSITE POLYMERIC LEISURE SHOE AND METHOD OF MANUFACTURE THEREOF

[76] Inventor: Francisco A. Salaverria, P.O. Box 685, Suisun City, Calif. 94585

[21] Appl. No.: 188,730

[22] Filed: Apr. 29, 1988

Related U.S. Application Data

[63] Continuation of Ser. No. 41,681, Apr. 23, 1987, abandoned, which is a continuation of Ser. No. 763,380, Aug. 6, 1985, abandoned.

[51] Int. Cl.[4] ..... A43B 3/12; A43B 13/32

[52] U.S. Cl. ..... 36/115; 36/12; 12/142 RS

[58] Field of Search ..... 36/11.5, 14, 19.5, 30 R, 36/32 R, 12, 19.5; 12/142 RS, 142 S, 142 T, 142 F

[56] References Cited

U.S. PATENT DOCUMENTS

| | | | |
|---|---|---|---|
| Re. 15,794 | 3/1924 | Cary | 36/30 R |
| 789,118 | 5/1905 | Butherfield | 36/14 |
| 1,293,337 | 2/1919 | Clark | 36/14 |
| 1,316,562 | 9/1919 | Dunphy | 36/30 R |
| 1,400,143 | 12/1921 | Dial | 36/14 |
| 2,124,621 | 7/1938 | Klaubauf | 36/12 |
| 2,323,562 | 7/1943 | Nugent | 36/30 |
| 2,350,852 | 6/1944 | Wehr | 36/30 |
| 2,538,673 | 1/1951 | Donahue | 36/19.5 |
| 2,619,441 | 11/1952 | Levy | 154/46 |
| 2,772,196 | 11/1956 | Pooley | 36/30 R X |
| 3,170,252 | 2/1965 | Ravich | 36/68 |
| 3,174,236 | 3/1965 | Field | 36/68 |
| 3,234,668 | 2/1966 | Radcliffe | 36/68 |
| 3,257,743 | 6/1966 | Closson, Jr. | 36/69 |
| 3,345,664 | 10/1967 | Ludwig | 12/142 |
| 3,590,411 | 7/1971 | Zemlin | 12/146 |
| 3,602,931 | 9/1971 | MacArthur | 12/146 |
| 3,629,050 | 12/1971 | Weinstein et al. | 161/64 |
| 3,693,269 | 9/1972 | Guarrera | 36/15 |
| 3,711,969 | 1/1973 | Weinstein et al. | 36/68 |
| 3,812,604 | 5/1974 | Sato | 36/14 |
| 4,047,310 | 9/1977 | Sunoo | 36/11.5 |
| 4,131,965 | 1/1979 | von den Benken et al. | 12/86.7 |
| 4,237,627 | 12/1980 | Turner | 36/3 B X |
| 4,245,406 | 1/1981 | Landay | 36/14 |
| 4,294,023 | 10/1981 | Banford | 36/11.5 |
| 4,331,731 | 5/1982 | Seike et al. | 428/305.5 |
| 4,434,518 | 3/1984 | Watanabe | 12/142 RS |
| 4,564,966 | 1/1986 | Chen | 36/31 |

FOREIGN PATENT DOCUMENTS

| | | | |
|---|---|---|---|
| 111476 | 9/1940 | Australia | 36/11.5 |
| 2989667 | 3/1982 | France | 36/12 |
| 2137638 | 10/1984 | United Kingdom | 36/12 |

*Primary Examiner*—Steven N. Meyers

*Attorney, Agent, or Firm*—Phillips, Moore, Lempio & Finley

[57] ABSTRACT

An improved composite polymeric leisure shoe having the upper portion of a shoe sole bonded to the lower surface of the shoe upper-insole using a non-visible porous interlayer (preferably a loosely woven fabric) and one or more adhesives. The bonding between the different synthetic polymeric surfaces of shoe upper-insole and the shoe sole is improved, and does not separate with normal use. A method of manufacture of the composite polymeric leisure shoe comprises applying an adhesive to both surfaces of the interlayer, placing the suitable adhesive side of the interlayer on the superior surface of the front part of a shoe upper-insole mold, bonding the interlayer to the lower surface of the shoe upper-insole by injection molding, applying the same or second adhesive to the lower interlayer surface of the shoe upper-insole and to the top surface of a shoe sole, and forming the leisure shoe by contacting the adhesive-coated surfaces of the shoe parts using suitable pressure. An additional method of manufacture of the composite polymeric leisure shoe comprises applying an adhesive to both sides of an interlayer and to the top surface of a shoe sole, placing the shoe sole with the interlayer on its top surface on the interior top surface of the front part of a shoe upper-insole mold, and heat injecting molding and forming in place the shoe upper-insole and completing the formation of the composite leisure shoe.

10 Claims, 3 Drawing Sheets

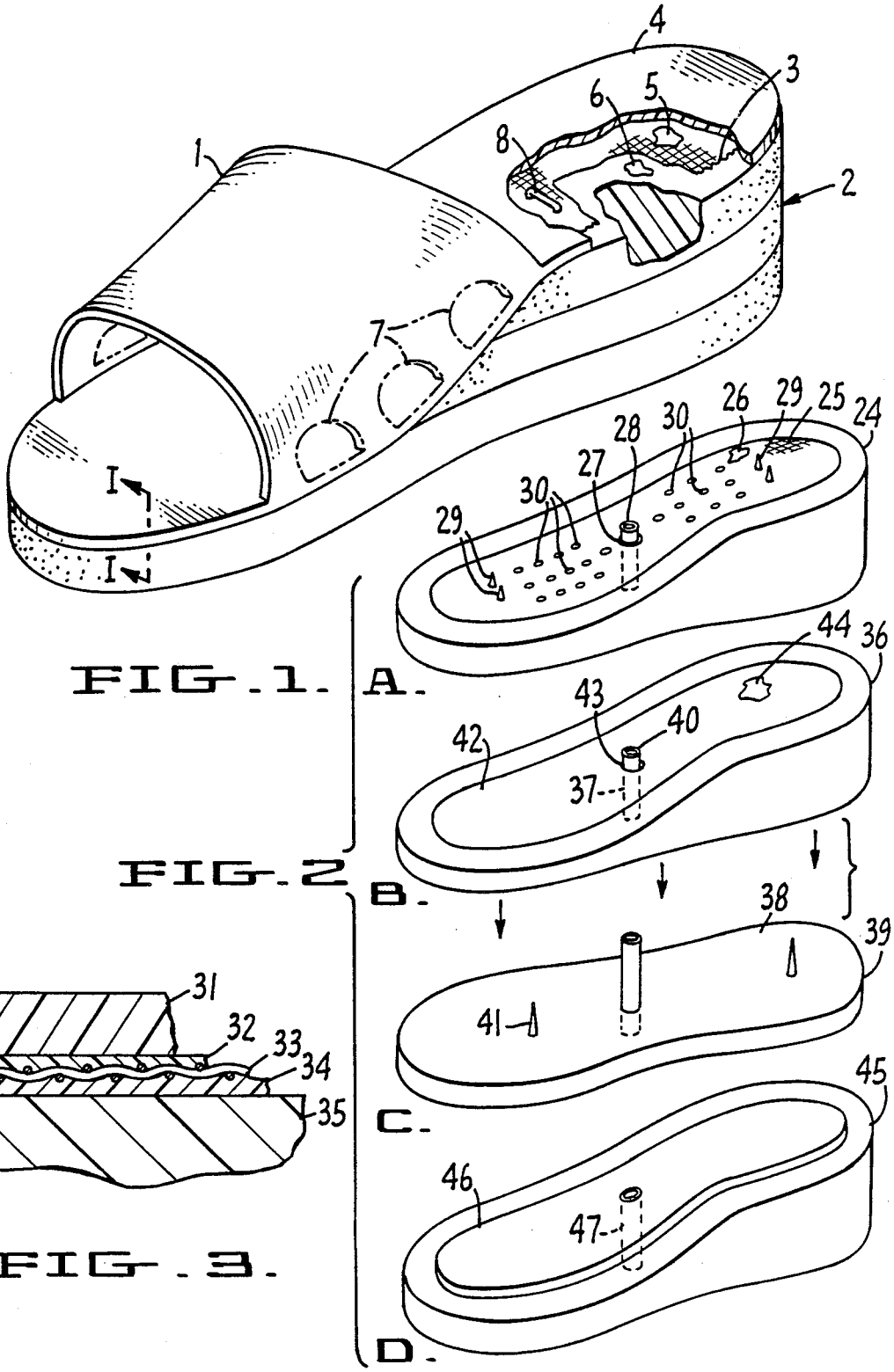
FIG. 1.
FIG. 2
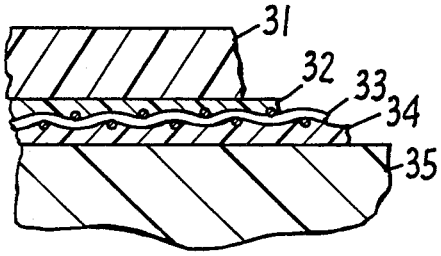
FIG. 3.

COMPOSITE POLYMERIC LEISURE SHOE AND METHOD OF MANUFACTURE THEREOF

This is a continuation of co-pending application Ser. No. 41,681 filed on Apr. 23, 1987, abandoned, which is a continuation of Ser. No. 763,380, filed Aug. 6, 1985, abandoned.

BACKGROUND OF THE INVENTION

1. Field of the Invention

The present invention relates to a leisure shoe or sandal. More particularly, the invention relates to a leisure shoe in which the top of the sole (usually a laminate) comprised of a synthetic polymer is easily bonded to the bottom of a synthetic polymeric shoe upper-insole comprising a second different synthetic polymer. The bonding between the different polymers using adhesives is improved using a fabric or perforated interlayer between the shoe upper-insole and the composite sole. As a result, the manufacturing process is simplified, and the shoe upper-insole and sole comprising different polymeric materials of the composite leisure shoe do not separate with extensive wear.

A leisure shoe sole made of synthetic polymers does not bond well to a synthetic polymeric shoe upper-insole, and the polymers are often inferior to natural materials. Further, the use of certain adhesives for bonding synthetic polymeric materials to each other is not completely satisfactory. Thus, peeling (or separation) of the different synthetic resins or polymers usually occurs quickly at stress points between the upper-insole and the sole during normal use. These stress points occur in the heel, toe, instep and sole portions of the shoe in normal walking. Further, for many people the ankle also turns out during walking which produces additional stress points on the sole. All of these motions create shear or peeling motions where different polymers of the sole are joined by adhesive. These stress points cause the polymers to separate. The different polymeric parts of the leisure shoe may be reinforced by nailing, stapling or sewing, because the soles also separate in time. Further, the nails or staples can become dangerous when sole wear is excessive. But these reinforcing methods are usually not desirable as far as the wearer of the shoe is concerned.

2. Related Art

The sole of a leisure shoe or sandal for beach or casual everyday wear is commonly made of different synthetic resins such as polyvinylchloride (P.V.C.), ethylene vinyl acetate copolymer resin (E.V.A.), polyamide resins, polyurethane resins, polycarbonate resins, and the like. The earlier-used natural materials, such as leather, cloth, or rubber, often do not have the necessary wearing or esthetic qualities, and are usually more costly as well.

In many instances, the bonding of a leather or artifical leather sole to a synthetic polymer shoe upper using an adhesive is not completely satisfactory.

Some patent references of interest in the shoe art include the following:

| Re: Number | Patentee | Date |
|---|---|---|
| 15,794 | Cary | 1924 |
| 1,316,562 | Dunphy | 1919 |
| 2,323,562 | Nugent | 1943 |
| 2,350,852 | Wehr | 1944 |

-continued

| Re: Number | Patentee | Date |
|---|---|---|
| 2,619,441 | Levy | 1952 |
| 3,170,252 | Ravich | 1965 |
| 3,174,236 | Field | 1965 |
| 3,234,668 | Radcliffe | 1966 |
| 3,257,743 | Closson, Jr. et al. | 1966 |
| 3,345,664 | Ludwig | 1967 |
| 3,590,411 | Zemlin | 1971 |
| 3,602,931 | MacArthur et al. | 1971 |
| 3,629,050 | Weinstein et al. | 1971 |
| 3,693,269 | Guarrera | 1972 |
| 3,711,969 | Weinstein et al. | 1973 |
| 3,812,604 | Sato | 1974 |
| 4,245,406 | Landay et al. | 1981 |
| 4,331,731 | Seike et al | 1982 |
| 4,335,528 | Watanabe | 1982 |
| 4,434,518 | Watanabe | 1984 |

However, none of these patents describe the composite leisure shoe of the present invention or the method of manufacturing it.

It is desirable to have a composite leisure shoe and a method of manufacturing it in which the bonding of the different synthetic polymers does not separate during normal use.

SUMMARY OF THE INVENTION

The present invention describes a composite leisure shoe comprising a synthetic polymeric shoe upper-insole and a different synthetic polymeric shoe sole, wherein the shoe sole is usually a laminate of a synthetic organic polymer, wherein the top of the shoe sole is bonded to the lower inferior surface of the shoe upper-insole in an improved manner by having a woven fabric or perforated polymeric sheet being used between the shoe upper-insole and the sole of a different polymeric material using one or more adhesives.

In another aspect, the present invention relates to a process for making a composite leisure shoe, which includes:

(a) coating one or both sides of a porous interlayer with a first organic adhesive, drying the applied adhesive and cutting the interlayer in the shape of a shoe insole;

(b) placing the interlayer of step (a) on the interior top surface of the front part of a suitable leisure shoe upper-insole mold;

(c) injecting a molten synthetic polymer resin into the mold to form a composite polymeric molded shoe upper-insole wherein the inferior surface of the shoe upper-insole has an interlayer surface;

(d) removing the shoe upper-insole having a fabric interlayer on the inferior surface;

(e) applying the same or a different adhesive to the inferior surface of the composite shoe upper-insole of step (d) and to the superior surface of a shoe sole;

(f) allowing the adhesive of step (e) to dry; and (g) forming the leisure shoe by contacting the adhesive-coated inferior surface of the shoe upper-insole with the adhesive-coated superior surface of the shoe sole of step (e) at a pressure of between about 50 and 100 pounds per square inch (psi) for between about 8 and 60 seconds.

In another aspect, the present invention relates to a process for making a composite leisure shoe, which process comprises:

(a) forming a composite shoe sole by a process which itself comprises:

(i) combining one or more layers of synthetic organic polymer whereby the layers of polymer of the shoe sole are bonded horizontally to each other, and (ii) the preformed shoe sole of step (i) having a perforation of suitable diameter and position as the tube found on the top surface of the front part of the shoe mold;

(b) applying an effective amount of a suitable first adhesive to both surfaces of a porous fabric interlayer, wherein the interlayer is smaller in dimension than the length and width of the composite shoe sole of step (a), and to the top surface of the preformed shoe sole of step (a);

(c) allowing the adhesive of step (b) to dry;

(d) placing the appropriate adhesive-coated side of the interlayer on the adhesive-coated top surface of the preformed shoe sole of step (b);

(e) placing the shoe sole of step (d) on the interior top surface of the front portion of injection mold suitable to form a leisure shoe upper-insole;

(f) injecting a molten second synthetic polymer resin into the mold to form a molded shoe upper-insole, the lower portion of which is bonded in a laminar fashion to the upper adhesive surface of the shoe sole of step (e);

(g) cooling and removing the molded leisure shoe from the injection mold; and (h) optionally placing a preformed polymer plug inside the hole in the bottom of the shoe sole or bonding another polymer layer horizontally to the bottom of the shoe sole using conventional adhesive and pressure.

In another aspect, the present invention relates to a process for making a composite leisure shoe, which process comprises:

(a) forming a composite leisure shoe sole by a process which itself comprises:

(i) combining one or more layers of a synthetic organic polymer with one or more layers of the same organic polymer whereby the layers of polymer are bonded to each other;

(b) applying a suitable first adhesive to the both surfaces of a fabric interlayer (such as resistant flannel), to the top surface of the preformed shoe sole of step (a), and to the lower surface of a preformed leisure molded shoe upper-insole wherein the interlayer is smaller than the composite shoe sole;

(c) allowing the adhesive to dry;

(d) placing the suitable adhesive side of the interlayer on the adhesive top surface of the shoe sole of step (b); and (e) bonding the laminated shoe sole of step (d) to the adhesive lower surface of the preformed molded shoe upper-insole of step (b) which comprises a different organic polymer resin using pressure and/or heat to re-activate the adhesive.

In another aspect, the present invention relates to a process for producing a composite leisure shoe, which process comprises:

(a) combining one or more layers of synthetic organic polymer whereby the layers of polymer of the shoe sole are bonded horizontally to each other;

(b) applying a suitable first adhesive to the lower surface of a preformed leisure molded shoe upper-insole (which has a cavity of a size equal to the thickness, form, and size of interlayer selected), and to the top surface of a porous interlayer wherein the interlayer is smaller than the shoe-insole;

(c) allowing the adhesive to dry;

(d) forming an assembly by contacting the adhesive-coated lower surface of the shoe upper-insole with the adhesive-coated top surface of the interlayer, both of step (b), and placing the interlayer into the preformed cavity in the lower surface of the molded shoe upper-insole using pressure, and/or heat to re-activate the adhesive;

(e) applying the same or a different adhesive to the lower surface of the assembly of step (d) and to the top surface of the preformed shoe sole of step (a);

(f) allowing the adhesive of step (e) to dry; and (g) forming the leisure shoe by contacting the adhesive-coated lower surface of the assembly including the shoe upper and insole+interlayer of step (e) with the adhesive-coated top surface of the shoe sole of step (a) using pressure.

In this embodiment, the interlayer needs perforations for air and adhesive to pass through, the interlayer materials include, for example Texon® (pasteboard), neolite, canvas, natural leather, etc., and thickness of the interlayer is between about 0.50 and 2.5 millimeters.

This new composite polymer leisure shoe is cooler than the conventional composite shoe. There are no holes in the bottom side of the sole to accumulate small stones, dust, wet soil and the like. The leisure shoe is attractive, fashionable, soft, light-weight and can be made in any desired color combination of colors. The configuration of the leisure shoe may be open at the back or optionally have one or more straps about the heel. Optionally, the shoe upper may be closed as in a conventional "loafer" or Oxford.

The composite shoe and the manufacturing processes described herein can be used by modifying and adapting to existing injection molding processes with little or no significant investment of time or capital.

BRIEF DESCRIPTION OF THE DRAWINGS

FIG. 1 is a perspective cutaway view of the composite leisure shoe, shoe upper-insole, adhesive, interlayer, alternative adhesive, and synthetic polymeric shoe sole of the present invention.

FIGS. 2A, 2B, 2C and 2D describe an exploded view of the different "front parts" of the leisure shoe upper-insole molds, which are used to make different types of molded shoe upper-insoles according to the present invention.

FIG. 3 is a cross-section of the leisure shoe taken along line I—I of FIG. 1.

DETAILED DESCRIPTION OF THE INVENTION AND PREFERRED EMBODIMENTS

Figure 4:
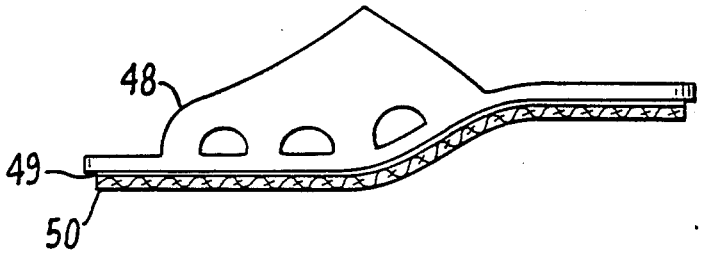
FIG. 4 is a side view of the composite shoe-insole and interlayer.

The composite leisure shoe of the present invention may be comprised of many different types of polymers for the upper part of the shoe insole and for the sole. The shoe upper-insole and sole do not separate at the bonding site of the different synthetic polymers because of the increased bonding obtained using the interlayer and adhesives between the polymer shoe upper-insole and sole.

Referring now to FIG. 1, is shown in cutaway view the composite shoe 1. The parts shown are composite sole 2, interlayer (or insert) 3, molded shoe upper-insole 4, first adhesive 5, adhesive 6, and optional venting holes 7 and optional staples 8. Leisure shoe 1 may be manufactured in a number of ways as is described hereinbelow in this application. Composite sole 2 is composed of any lightweight polymeric material. Preferably, the same or different polymers are provided in a laminate of the sole usually in different colors to produce a pleasing effect to the eye. Useful polymeric materials include ethylene vinyl acetate copolymer resin (E.V.A.), polyurethane resins, polystyrene resins, polycarbonate resins, and the like. These resins have desirable properties of being light weight, low water-absorption, durability and resistance to wear and abrasion. Preferably, the polymers of sole 2 have a foam-like texture so they are light in weight. More preferably, ethylene vinyl acetate copolymer (E.V.A.) resin is used for sole 2. E.V.A. resin has a soft, almost foamed texture. It is used primarily because it is light weight but durable. It is not contemplated that cleats or other hard objects would be imbedded in this type of sole for sports shoe (i.e., baseball shoes, golf shoes, etc.) use.

The interlayer 3 as used in the present invention is made up of porous materials which do not undergo thermal change or deformation under the conditions of polymeric injection molding. A further desirable property of interlayer 3 is that it has good bonding properties to the adhesive(s) used. Useful materials for interlayer 3 include, for example, thin leather, artificial leather, and woven and nonwoven fabrics (polymers). Where the original material is essentially a thin solid sheet, a number of holes (or perforations, see FIG. 2, no. 30) are preferred, so that adhesive 5 may contact additional surface area of porous interlayer 3. More importantly, the perforations are useful to prevent air bubbles from forming between interlayer 3 and shoe upper-insole 4 to weaken the bond when the adhesive is used. Perforations in interlayer 3 may be of any small size so that the air bubbles do not form, and good adhesion is obtained with the adhesive. Holes of between about 0.01 to 0.15 inches in diameter and having centers between about 0.25 to 1.0 inch apart are useful. Woven fabric, felts or fibers are preferred as porous materials for interlayer 3. Woven fabrics and natural fibers such as cotton or wool are preferred. A more preferred fiber is cotton. Most preferably, loosely woven cotton fabric having visible air spaces or having a thread count of between 10 and 100 threads per square inch in both directions (length and width) is particularly useful. Preferably, the thread count is between about 40 to 80 threads per square inch in each direction. This kind of fabric is very resistant to separation. The threads are inseparable, and it has a good bond to the polymers used as adhesives. Practically, interlayer 3 is invisible, and does not detract from the shoes' flexibility and softness. Also, the shoes made with this interlayer are waterproof, because the threads are completely bonded within the polymeric adhesive.

The thickness of interlayer 3 should be minimal so that it does not interfere with the normal function or feel of the leisure shoe. A thickness of between about 0.05 and 0.15 inches is useful. A thickness of interlayer 3 of between about 0.05 to 0.1 inches is preferred.

The length and width of interlayer 3 is always less than the length and width of sole 2 and of the shoe upper-insole 4 so that the threads are completely enclosed in the polymer adhesive. The interlayer is not decorative, is not seen, and is functional to provide increased bonding between shoe upper-insole 4 and sole 2. Usually interlayer 3 is between about 0.3 to 3.0 mm. smaller than length and width of shoe upper insole 4. Preferably, the interlayer is about 1 mm from the edges of the upper-insole in all directions. One or more staples 8 or similar fastening devices or means may be used to hold the insert in place so that it does not move during the hot injection process to form the shoe upper-insole 4.

Interlayer 3 is further bonded to the top of sole 2 using adhesive 6 which is compatible with the materials of construction. The usual procedure is to use a polyurethane-type adhesive 5 to bond the sole 2 to interlayer 3. The adhesive may be coated on both the superior surface of the sole and the inferior surface of the interlayer 3. Neoprene-type adhesive should not be used in direct contact with P.V.C. because the acids in the neoprene tend to decompose the P.V.C. The adhesive is allowed to dry. In some embodiments, adhesive 5 may be placed on one or both surfaces of the interlayer 3 and dried. The dried adhesive-coated interlayer is then cut to a size slightly smaller than the eventual shoe upper-insole.

Figure 5:
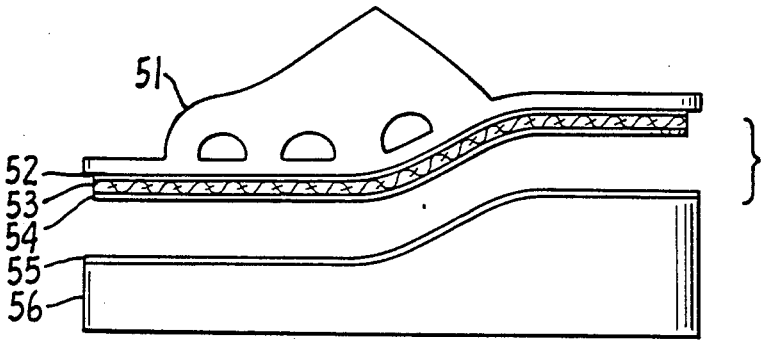
FIG. 5 is a side view of the sole and the molded shoe upper-insole having the interlayer adhered to the inferior surface of the shoe upper-insole.

The leisure shoe 1 shown in FIG. 1 is manufactured a number of ways according to the present invention. In one embodiment as shown in FIG. 2A, a front part of mold 24 is prepared placing interlayer 25 on its top surface. Interlayer 25 (which is the same as interlayer 3 in FIG. 1) is always cut smaller than either the upper-insole 51 (FIG. 5) and the composite sole 56 (FIG. 5). Usually interlayer 25 is at least one millimeter smaller than the sole on each side. Interlayer 25 has adhesive 26, preferably a polyurethane-type, applied to the top surface or preferably both top and bottom surface. This operation or function may be done earlier in time and in large sheets as a practical method of obtaining an adhesive coated interlayer 25. The interlayer has a hole 27 of between about 0.15 to 0.40 inches in diameter (the same diameter as tube 28) at or near to the center of the surface of the interlayer (width and length). The front part of mold 24 has a hollow tube 28 extending up from about the center of the bottom mold. The tube protrudes between about 1/32 and 3/64 inch above the interlayer. Small metal prongs 29 optionally protrude through interlayer 25 to assist in keeping it in place during injection molding. These prongs may be any number or location or direction sufficient to keep interlayer 25 in place. The importance of the configuration of the hollow tube and prongs are that they help to keep the interlayer from moving during injection molding. The front part of the mold 24 is placed into the cavity formed by the lower, shoe last, and top parts of the injection mold. As the molten polymer enters upper-insole shoe mold through hollow tube 28, it first contacts the shoe last and then interlayer 25 secured in place by tube 28 and prongs 29 and slowly fills the open space in the mold, and produces the shoe upper-insole 4, having interlayer 25 intimately adhered to the inferior surface of the shoe upper-insole.

In FIG. 3 is shown a cut-away view of the layers of the composite leisure shoe in a vertical, cut along line I—I in FIG. 1. Upper shoe-insole 31, 32 is an adhesive layer, usually polyurethane, interlayer 33 is preferably a loosely woven cotton adhesive 34 is preferably polyurethane or neoprene (with the precautions mentioned herein), and sole 35 is usually made of E.V.A. This view shows more explicitly how it is believed the bonding occurs within the composite shoe.

The invention is also seen in FIG. 4. Upon cooling, the composite shoe upper 48 having the interlayer 50 (which is the same as interlayer 3 in FIG. 1 and interlayer 25 in FIG. 2) adhering to the bottom of the insole 49 is removed from the mold as seen in FIG. 4. The coated fabric on the inferior surface of the insole then has a small piece of cloth, paper, fabric or the like added to cover the hole where the tube extended through the fabric. This step is needed when neoprene-type cement is used because the acids in neoprene cause the polyvinyl chloride polymer to decompose.

In FIG. 5, is shown shoe upper-insole 51, adhesive 52, interlayer 53, adhesive 54, adhesive 55 and sole 56. The inferior surface of the shoe upper-insole is then coated with an adhesive, as is superior surface of the composite sole. Usually more polyurethane-type adhesive is used. Neoprene-type adhesive is also a preferred adhesive if hole 27 (in FIG. 2A) is covered to prevent mixing. The adhesive is allowed to dry. The adhesive coated inferior insole surface 54 and superior composite sole surface 55 are then pressed together using pressure of between about 50 and 100 pounds per square inch (psi), preferably about 70 psi for between about 10 and 60 seconds, preferably about 15 seconds. This operation is performed in a manner to eliminate all bubbles which interfere with the necessary adhesion.

The polymer normally used to make unit molded shoe upper-insole 4 is usually polyvinylchloride (P.V.C.) Preferred colors are usually opaque (without internal shine). The insole thickness is usually between about 4/32 and 5/32 of an inch.

In another preferred embodiment of the present invention, as shown by FIGS. 2B and 2C, an adhesive 44, such as a polyurethane-type, is applied to the top of sole 36 and to both sides of interlayer 42 and allowed to dry. Sole 36 having a perforation 37 is placed on the top surface 38 of the front part of an injection mold 39 having a tube 40 protruding through the sole 36 for the injection molding of the P.V.C. and inserted in prongs 41. Interlayer 42, having small hole 43, is placed on the top of sole 36, tube 40 protrudes between about 1/32 and 3/64 inch above the cloth interlayer 42. The front part of the mold 39, with the sole 36 and interlayer 42 on its top surface 38 is placed into the cavity form by the lower, shoe last, and top parts of the injection mold. Then the shoe [upper-insole portion 4 (FIG. 1) or upper portion 51 (FIG. 5)] of the leisure shoe is hot-injection molded in a conventional manner producing the composite leisure shoe shown in FIG. 1. Optionally, a preformed polymer plug may be placed inside the hole in the bottom of the shoe sole, or to bond another polymer layer horizontally to the bottom of the shoe sole using a suitable adhesive and pressure. If the edges of the composite leisure shoe need to be finished further, this is accomplished using sandpaper, knife or similar means.

As shown in FIG. 1, during the heat molding and solidification sole 2, interlayer 3 and upper 4 are completely heat bonded to each other. Peeling or separation of the different polymeric layers of the composite leisure shoe does not occur during normal use.

In another preferred embodiment of the composite leisure shoe of FIG. 1, sole 2 is a laminated ethylene vinyl acetate copolymer (E.V.A.), adhesive 6 on E.V.A. sole 2 is a polyurethane-type, interlayer 3 is a resistant flannel, cloth-type towel, or wool; adhesive 5 on both sides of the fabric and the lower surface of the shoe upper-insole 4 made of polyvinyl chloride (P.V.C.) is always polyurethane-type adhesive.

Figure 6:
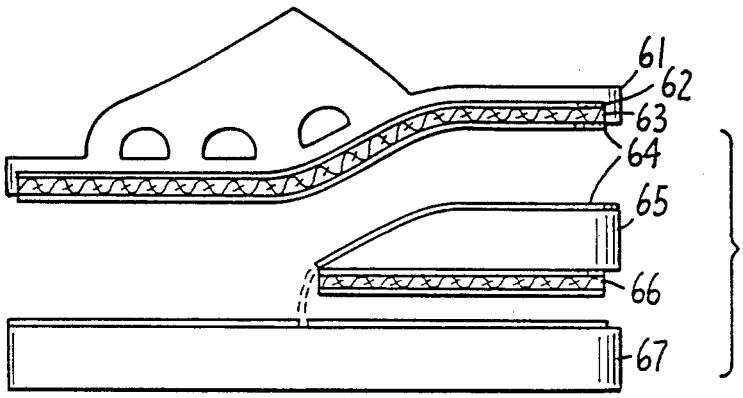
FIG. 6 is a side exploded view of the composite leisure shoe having different layers of synthetic polymer.

FIG. 6 shows another embodiment of the present invention showing the molded shoe-upper insole 61, adhesive 62, interlayer 63, adhesive 64, a wedge for the composite sole 65 (usually of E.V.A.), an adhesive layer and optional fabric interlayer 66, and lower composite sole 67. The molded shoe upper-insole 61 has a cavity in the lower surface in which the interlayer 63 is placed. The purpose of this cavity is to make non-visible and to protect interlayer 63. This cavity is produced by the front part of the mold 45, shown in FIG. 2D. The front part of the mold 45 has in metal relief on the top surface something as an interlayer 46, which has a thickness, form and size equal to the interlayer 63 selected. The polymer is injected into the shoe upper-insole mold through orifice 47. Examples of interlayers in this case include; Texon® (pasteboard), neolite, natural leather, canvas, etc. which have a thickness between about 0.50 and 2.5 milimeters. Also, these interlayers need perforations.

To make the molded shoe upper-insole, usually of P.V.C., it is preferable to use a suitable injection mold and coloring agents which will give to the P.V.C. an opaque color (without an internal shine). Also, the colors found in the composition sole usually of E.V.A. are opaque.

It is also possible, according to the present invention, to adapt the existing conventional P.V.C. shoe injection molds in use or obsolete to this new process easily. It is necessary to modify the "front part" of the molds. The P.V.C. in the flow state is injected into the mold through the orifice-small tube localized respectively on the exterior and top interior surfaces of the front part of the injection mold. The front part of the mold determines the form (holes in the bottom) and thickness of the soles in the conventional plastic shoes, and after being modified determines the form and thickness of the shoe-insole of the new manufacturing method. The thickness of the conventional front parts of the injection molds can be augmented, such augmentation is made only in the top interior surface in order to enter more into the cavity form by the lower, shoe last, and top parts of the mold, so that the space between the shoe last and interior (top) surface of the front part is reduced, and thus changes the conventional sole thickness to shoe-insole thickness. A thickness of 4/32 or 5/32 of an inch is suitable for the shoe-insole. The new top interior surface of the front part must have a smooth surface and does not have to lose any curvature of the original conventional interior (top) surface of the front part of the mold.

Figure 7A:
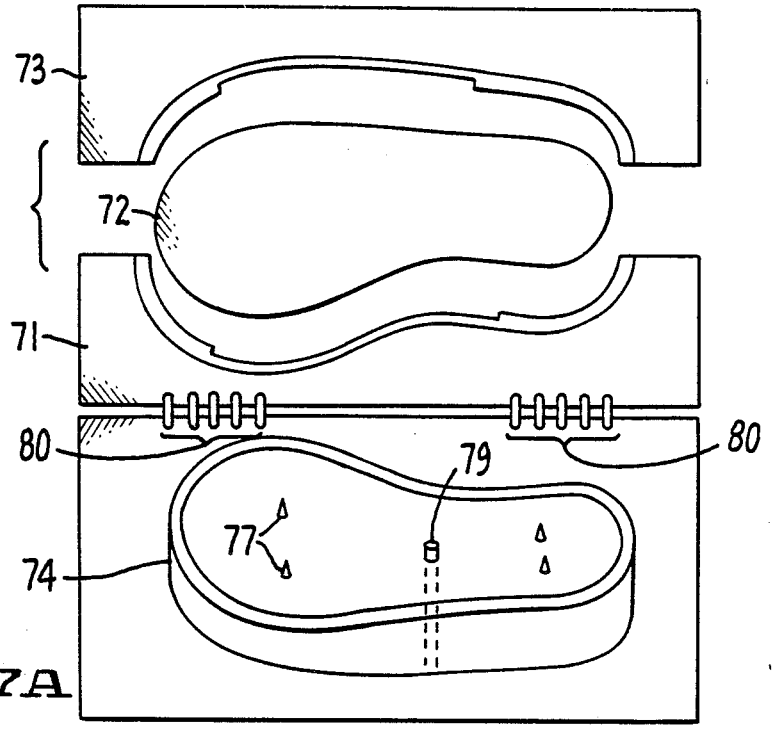
FIGS. 7A and 7B show a type of shoe upper-insole injection mold.
Figure 7B:
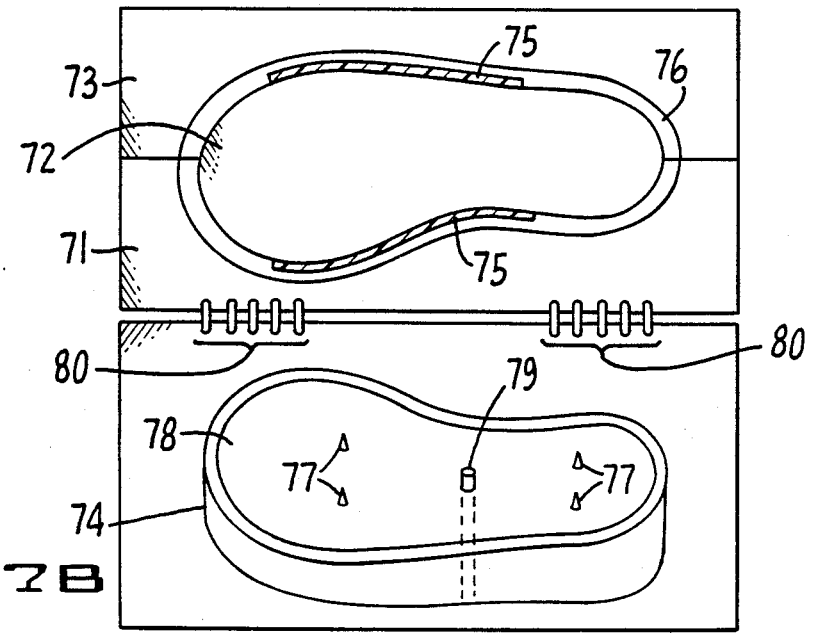

The injection molds used to make the conventional plastic shoes and the shoe uppers-insoles of the present invention have generally 4 parts. In FIG. 7A are shown the parts of a shoe upper-insole mold: Lower part 71, shoe last 72, top part 73, and front part 74. The shoe last is located between the lower part 71 and top parts 73, and in the open spaces 75 found in these mold parts is where the shoe "upper" is formed (See 48, FIG. 4). In FIG. 7B, the lower part 71, shoe last sole 72, and top part 73 of the injection mold form the cavity 76 in which the front part 74 enters when the shoe upper-insole mold is closed using hinges 80. The shoe "insole" is molded within this cavity. The open space between the shoe last sole 72 and the interior top surface of the front part 74 determines the thickness and form of the shoe insole, and its edges are determined by the lower part 71 and top part 73. After the injection molding of fluid polymer, the mold parts are automatically separated using hinges 80 (shoe last 72, top part 73 and front part 74—lower part 71 stays in its place on the injecting machine), the shoe upper-insole 48 remains formed (molded) on the shoe last which is removed. Prongs 77 hold interlayer 78 in place as the molten polymer, preferably polyvinyl chloride, enters the cavity through protruding tube 79.

The tube 79 through which the P.V.C. is injected into the mold and extended as a small tube, has a height above the shoe sole and interlayer of about 1/32 to 3/64 inches. The small protruding tube is very important because its function is to allow the plastic in the fluid stage to contact but not move the interlayer. It is also possible to avoid movement of the interlayer by using one or more small staples, prongs or similar means to avoid movement of the interlayer. However, the preferred method is to make a suitable P.V.C. shoe injection mold to make the shoe upper-insole, considering that this portion is going to be bonded to an E.V.A. sole. Usually, the edges of the composite shoe soles need to be finished further, before or after the shoe parts are glued together. This is accomplished using sandpaper or similar means. For this reason, the sole is at least 0.5 to 1.0 millimeter larger than the shoe-insole on each side.

While the present invention has been described with reference to the specific embodiments thereof, it will be understood by those skilled in the leisure shoe manufacturing art that various changes may be made and that equivalent steps may be substituted without departing from the true spirit and scope of the present invention. All such modifications or changes are extended to be included within the scope of the following claims.

What is claimed is:

1. A composite leisure shoe comprising:

a synthetic polymeric shoe upper-insole having a generally flat lower surface, a synthetic polymeric lower shoe sole of a synthetic foam polymeric material having a generally flat top surface wherein the synthetic foam polymeric material is different from the material comprising the shoe upper insole, and a flexible interlayer therebetween forming a combined sole with the upper insole and the lower shoe sole, the combined sole of the composite leisure shoe has at least one layer of a synthetic polymeric material bonded to a synthetic foam polymeric material different from the synthetic polymeric material of said at least one layer, such that the bonding between the top flat surface of the synthetic foam polymeric lower shoe sole and the lower flat surface of the synthetic polymeric shoe upper-insole of the composite leisure shoe includes a first adhesive and said interlayer of a loosely woven fabric is adhered between the lower surface of the upper-insole and the top surface of the synthetic foam polymeric lower shoe sole wherein the interlayer is smaller than the lower surface of the shoe upper-insole and is between about 0.3 and 3.0 millimeters of the lower peripheral edge of the shoe upper insole, and a second adhesive adheres the interlayer to the lower shoe sole, whereby the synthetic polymeric shoe upper-insole remains integrally adhered to the synthetic foam polymeric lower shoe sole during use.

2. The composite leisure shoe of claim 1 wherein the synthetic polymeric material of the lower shoe sole is ethylene vinyl acetate copolymer (E.V.A.).

3. The composite leisure shoe of claim 1 wherein the polymeric material of the upper portion and upper-insole of the composite leisure shoe is polyvinyl chloride (P.V.C.).

4. The composite leisure shoe of claim 3 wherein the synthetic polymeric material of the lower shoe sole is ethylene vinyl acetate copolymer (E.V.A.).

5. The composite leisure shoe of claim 4 wherein the first adhesive is a polyurethane-type cement.

6. The composite leisure shoe of claim 5 wherein the second adhesive is a neoprene rubber cement.

7. The composite leisure shoe of claim 6, wherein the fabric interlayer is selected from the group consisting of natural fiber and woven fabric.

8. The composite leisure shoe of claim 7 wherein the fabric interlayer is the natural fiber cotton.

9. A composite leisure shoe comprising a synthetic polymeric shoe upper-insole having a lower substantially flat surface, a lower shoe sole of a synthetic foam polymeric material having a top substantially flat surface, wherein the synthetic foam polymer material is different from the material comprising the shoe upper insole, and a loosely woven fabric interlayer therebetween, which composite leisure shoe consists essentially of a synthetic polymeric shoe upper-insole having the lower substantially flat surface of the shoe upper-insole bonded adhesively using a first adhesive to one flat surface of a loosely woven fabric interlayer, wherein the periphery of the interlayer is smaller than periphery of the lower surface of the upper insole, and the other substantially flat surface of the interlayer is adhesively bonded using a second adhesive to the top substantially flat surface of a synthetic foam polymeric lower shoe sole, whereby said shoe upper-insole remains integrally adhered to said lower foam shoe sole during use.

10. In an improved composite leisure shoe consisting essentially of a cured polyvinyl chloride upper-insole having a lower generally flat top surface and a foam-like ethylene vinyl acetate copolymer lower shoe sole having a generally flat top surface, the improvement comprising a porous flexible interlayer positioned between the upper-insole and the lower shoe sole; wherein (A) the cured polyvinyl chloride upper insole on its lower generally flat surface is adhesively bonded using a polyurethane adhesive to (B) one generally flat surface of the interlayer which is porous to the polyurethane adhesive, wherein the interlayer itself consists essentially of a loosely woven porous fabric and the fabric interlayer is smaller than the lower flat surface of the upper-insole, and the foam-like lower shoe sole and the periphery of the interlayer extends to within between about 0.3 and 3.0 mm of the peripheral outer edge of the lower surface of the upper-insole, and the other generally flat surface of the porous interlayer is adhesively bonded using neoprene rubber adhesive to (C) the top generally flat surface of the preformed foam-like ethylene vinyl acetate copolymer lower shoe sole, whereby the interlayer and first and second adhesives remain integrally adhered to the upper insole and foam-like lower shoe sole during use.

* * * * *